United States Patent [19]

Smith

[11] Patent Number: 4,863,068

[45] Date of Patent: Sep. 5, 1989

[54] POST-MIX DRINK DISPENSER

[75] Inventor: Dell W. Smith, Los Angeles, Calif.

[73] Assignee: Bar-Master International, Los Angeles, Calif.

[21] Appl. No.: 199,429

[22] Filed: May 27, 1988

[51] Int. Cl.[4] ..... B67D 5/56

[52] U.S. Cl. ..... 222/129.1; 222/506; 222/559; 137/630.22; 137/607

[58] Field of Search ..... 222/129.1–129.4, 222/148, 506, 559; 137/607, 630.22, 628

[56] References Cited

U.S. PATENT DOCUMENTS

| | | | |
|---|---|---|---|
| 912,604 | 2/1909 | Olsson | 137/630.22 |
| 2,717,806 | 9/1955 | Dale | 137/628 X |
| 3,863,810 | 2/1975 | Hanson | 222/129.1 |
| 4,128,190 | 12/1978 | Gruber | 222/129.2 |
| 4,146,056 | 3/1979 | Buchanan | 137/630.22 |
| 4,205,784 | 6/1980 | Monigold | 137/630.22 X |
| 4,726,493 | 2/1988 | Wallace et al. | 222/129.1 |

OTHER PUBLICATIONS

Booth, Inc. Post-Mix Systems, Sure-Flow Valve Specifications Brochure dated 10/82-3 pages.

The Cornelius Company, Post-Mix Price List, Effective, Jan. 5, 1987-3 pages.

*Primary Examiner*—Joseph J. Rolla

*Assistant Examiner*—Gregory L. Huson

*Attorney, Agent, or Firm*—Harris, Kern, Wallen & Tinsley

[57] ABSTRACT

A touch faucet post-mix drink dispensing system for simultaneous dispensing of syrup and soda with a single valve chamber and two poppets in tandem. The poppets are spaced for positive seating and sequential opening of the soda and syrup flow paths with a single motion of the actuating lever resulting in a reduction of the required actuating force and thereby less load on the drink cup and reduced likelihood of damage to the cup.

9 Claims, 5 Drawing Sheets

POST-MIX DRINK DISPENSER

BACKGROUND OF THE INVENTION

This invention relates to post-mix drink dispensing systems, and in particular to a new and improved system for simultaneous dispensing of soda and syrup in separate flow paths for subsequent mixing.

A wide variety of drinks are dispensed in post-mix dispensers with a syrup or other concentrate and a carbonated water or other diluent provided from separate sources and controlled by valve arrangements for mixing in the outlet nozzle of the dispensing apparatus. Some of the dispensers are electrical, with the valves being operated by electrical switches and solenoids, and some are mechanical, being operated by manually pushing a botton or a lever. The present invention is directed to a mechanical type dispenser.

In one type of mechanical dispenser, the valving is controlled by push buttons adjacent the outlet nozzle. In another mechanical type of system, usually known as a touch faucet, the valving in controlled by a lever positioned adjacent the outlet nozzle and the lever is actuated by the operator pushing the drink cup against the lever. This type of device is widely used in refreshment stands, fast food restaurants and self-service establishments.

Often the drink cup used with a touch faucet dispenser is a non-reusable item and hence it is desirable to have the cup made of a minimum amount of material. These types of cups are relatively flexible and easily distorted or collapsed, particularly when being forced against the lever of a touch faucet dispenser. Therefore it is desirable that the dispenser be operable with a minimum of force. However at the same time, the valving arrangement needs to have positive seating in order to avoid leakage which is both messy and costly in lost materials.

All valve mechanisms use some sort of moving component or poppet which rests against another component or seat to provide a sealing arrangement. Opening of the valve for fluid flow between the poppet and the seat requires force sufficient to break the hydrostatic seal between the poppet and seat as well as sufficient to move the poppet. Prior art post-mix dispensing systems have been of two types. In one arrangement, separate valves have been used for the syrup and for the soda, with the valve chambers usually arranged in parallel, with a separate poppet sliding in each chamber. The actuating mechanism engages both poppets at the same time and moves both from the closed or sealing position to the open or flow position. In the other arrangement, a single valve poppet is positioned in a single valve chamber having two valve seats. Two separate seat engaging lands are provided on the valve poppet spaced so as to simultaneously engage the two valve seats. In both of theses arrangements, actuation of the dispenser requires breaking of two hydrostatic seals at the same time as the poppet or poppets are moved.

SUMMARY OF THE INVENTION

It is an object of the present invention to provide a new and improved post-mix dispensing system suitable for use in a touch faucet dispenser wherein the dispenser is actuated by a single motion while sequentially breaking the hydrostatic seals for the two fluid flow paths. A further object is to provide such a dispensing system wherein the inlet and outlet ports for the two fluid flow paths are provided in a single valve chamber, with separate aligned valve poppets for controlling the two flow paths. An additional object is to provide such a system wherein motion of the actuating lever initially moves the first valve poppet to break the first hydrostatic seal, with this motion of the first valve poppet engaging the second valve poppet and breaking the second hydrostatic seal after the first seal is broken. Another object of the invention is to provide such a system with the inlet flow paths, the valve chamber, and the outlet flow paths to the nozzle incorporated in a single unitary housing.

Other objects, advantages, features and results will more fully appear in the course of the following description.

The presently preferred embodiment of the invention comprises a post-mix drinking system with a housing having a valve chamber with first and second inlet ports, first and second outlet ports, and first and second valve seats. The first valve seat has a first opening defining a flow path in the valve chamber between the first inlet and outlet ports, and the second valve seat has a second opening defining a flow path in the valve chamber between the second inlet and outlet ports. A first valve poppet is slidingly positioned within the first opening for sealing engagement with the first valve seat and a second valve poppet is slidingly positioned in the second opening for sliding engagement with the second valve seat, with the first valve poppet spaced from the second valve poppet when both are in sealing engagement with the respective valve seats. The valve actuator, typically a touch lever, engages the first poppet for moving it away from the first valve seat and into engagement with the second poppet which is then moved away from the second valve seat.

In the preferred embodiment, a spring is utilized for urging the second or syrup controlling poppet into sealing engagement with the second valve seat, with the pressure of the soda being utilized to urge the first or soda controlling poppet into engagement with the first valve seat.

DESCRIPTION OF THE PREFERRED EMBODIMENT

Figure 1:
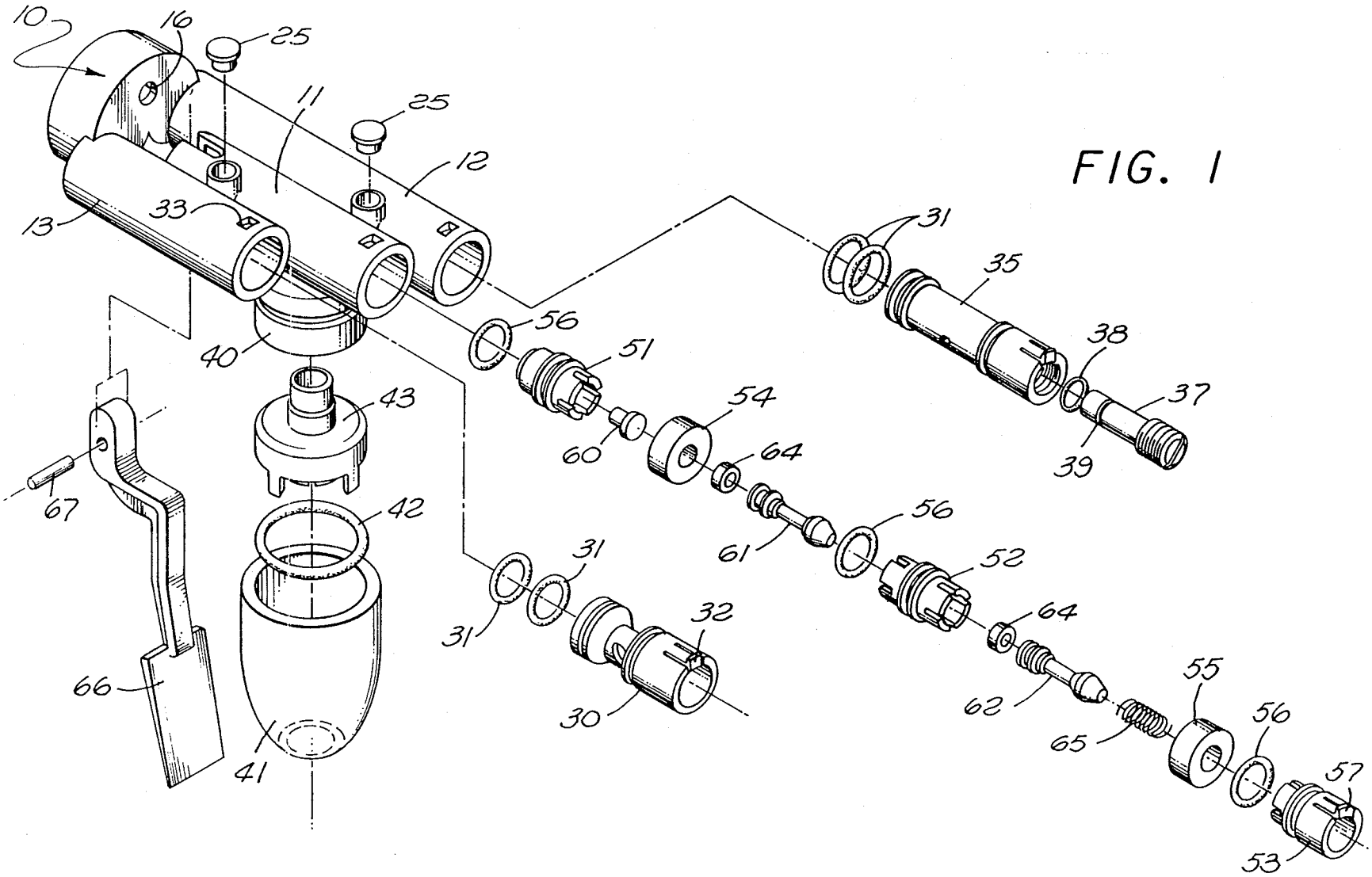
FIG. 1 is an exploded view of a touch faucet postmix embodiment of the invention; drink dispensing system incorporating the presently preferred
Figure 2:
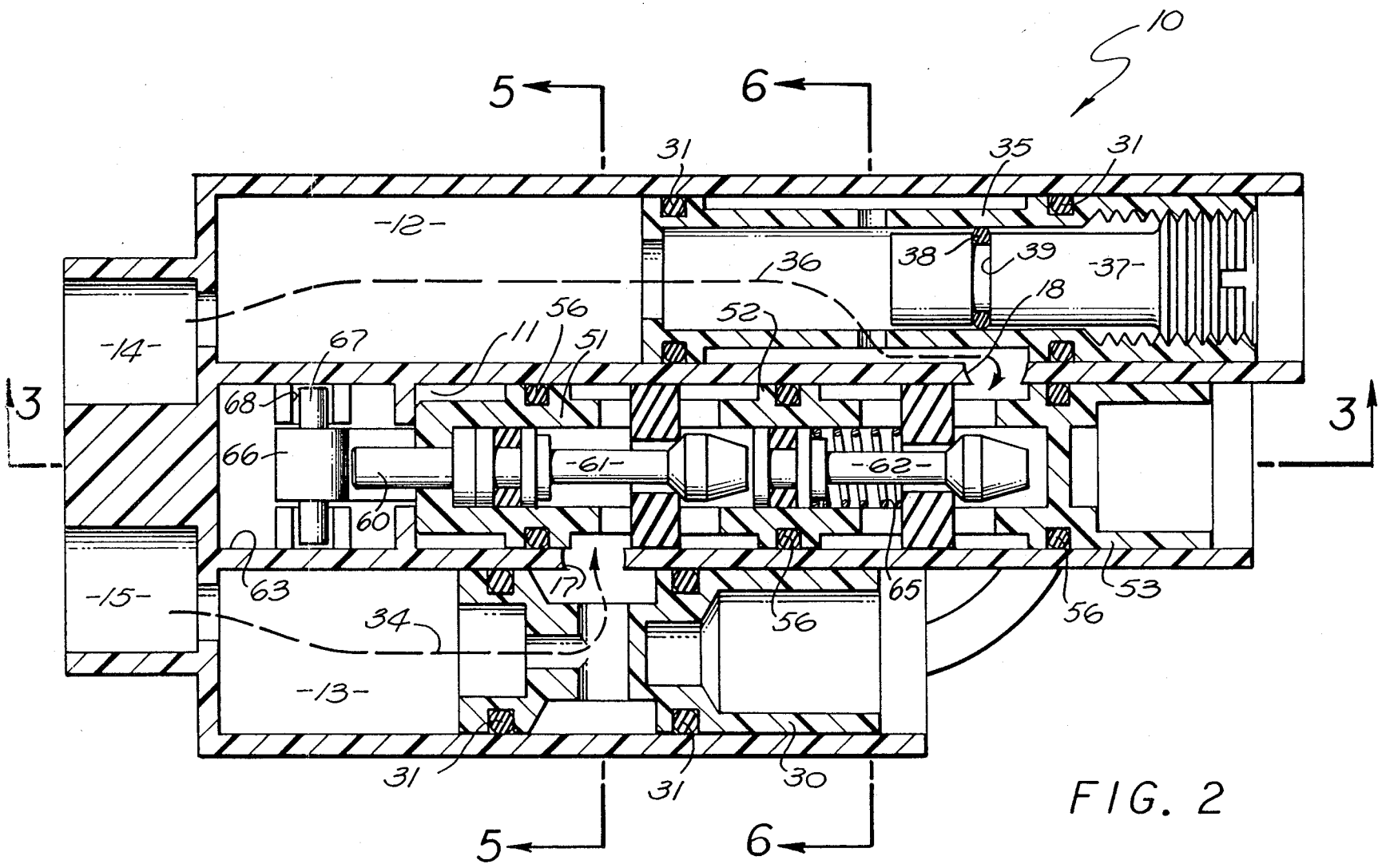
FIG. 2 is an enlarged horizontal sectional view through the dispenser of FIG. 1.

In the preferred embodiment illustrated, a housing 10, preferably a unitary plastic molding, has a valve chamber 11 and inlet chambers 12, 13. Inlet openings 14, 15 are provided for receiving the ends of fluid supply lines, and in the embodiment illustrated, a syrup supply line is inserted at inlet opening 14 and a soda or carbonated water supply line is inserted at inlet opening 15. A passage 16 in the housing is provided for mounting.

An inlet port 17 is provided between the inlet chamber 13 and the valve chamber 11, and another inlet port 18 is provided between the inlet chamber 12 and the valve chamber. An outlet port 19 is provided between the valve chamber 11 and an outer zone 21 of an outlet chamber 22, and an outlet port 20 is provided between the inlet chamber 11 and an inner zone 23 of the outlet chamber 22. In forming the inlet ports 17, 18 in the single molded housing, core plugs are required, leaving openings which are closed by caps 25.

Figure 6:
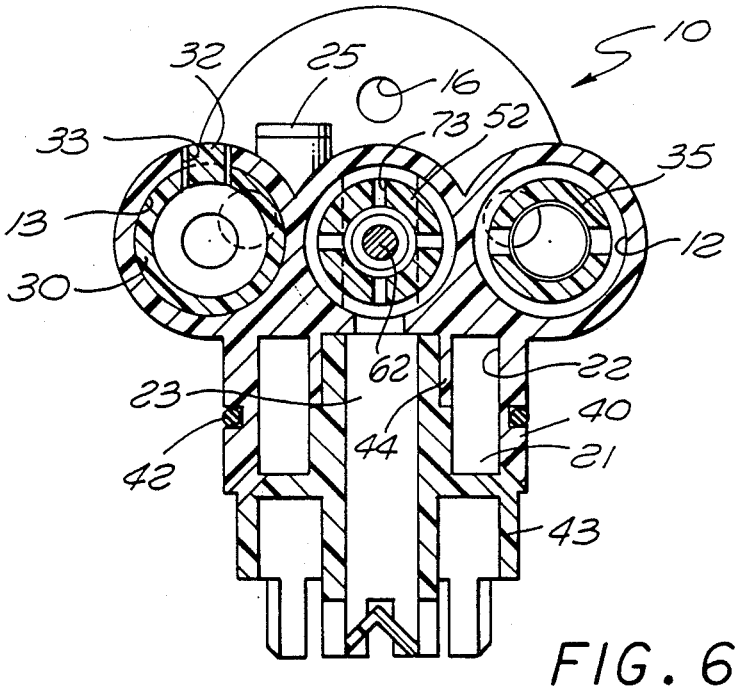
FIG. 6 is a sectional view taken along the line 6—6 of FIG. 2.
Figure 5:
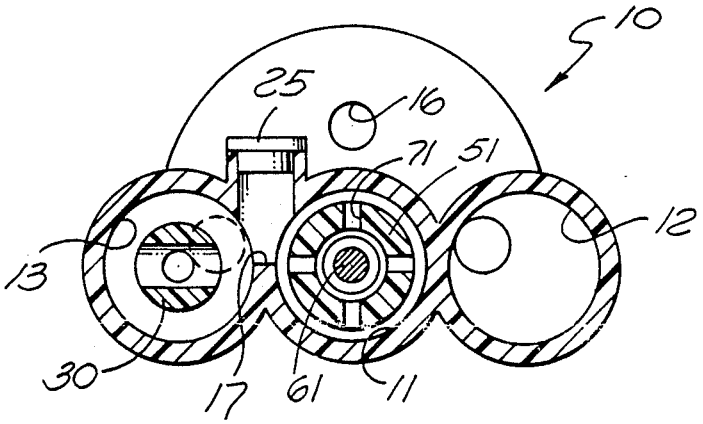
FIG. 5 is a sectional view taken along the line 5—5 of FIG. 2.

A plug 30 is slidingly positioned in the inlet chamber 13, with O-ring seals 31. The plug is held in position by a tab 32 of the plug engaging a slot 33 in the housing (FIG. 6). Passages in the plug 30 provide a flow path from the inlet chamber 13 to the inlet port 17 as indicated by the dashed line 34. A plug 35 is similarly positioned in the inlet chamber 12 and provides a flow path to the inlet port 18 as indicated by the dashed line 36. The plug 35 may be closed at its outer end in the manner of the plug 30. However in the embodiment illustrated, an adjustment insert 37 is threaded into the outer end of the plug 35 for adjustment of the rate of flow along the path 36, with an O-ring seal 38 in a groove 39 of the insert 37.

Figure 3:
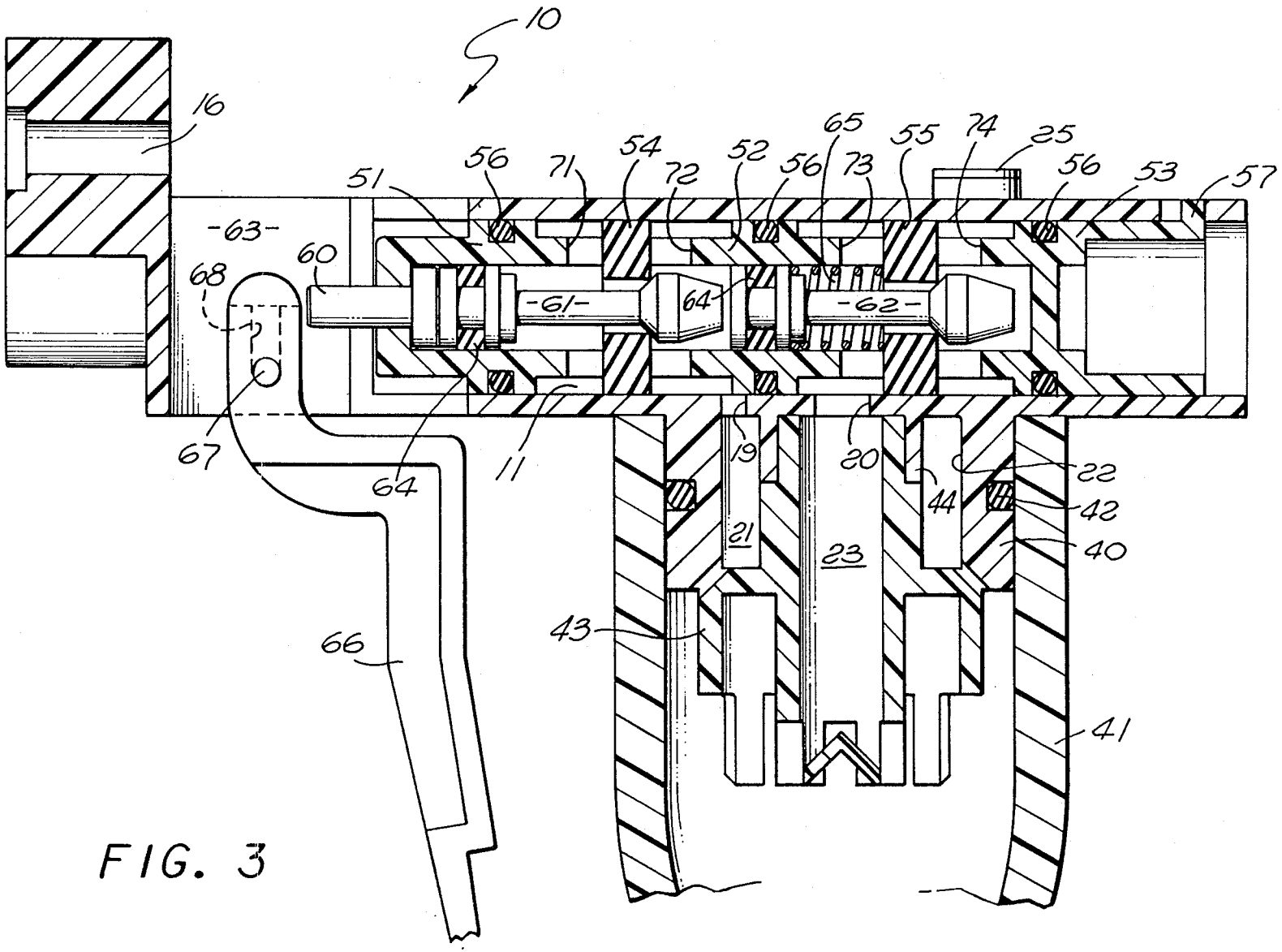
FIG. 3 is a sectional view taken along the line 3—3 of FIG. 2 showing the dispenser in the closed position.
Figure 4:
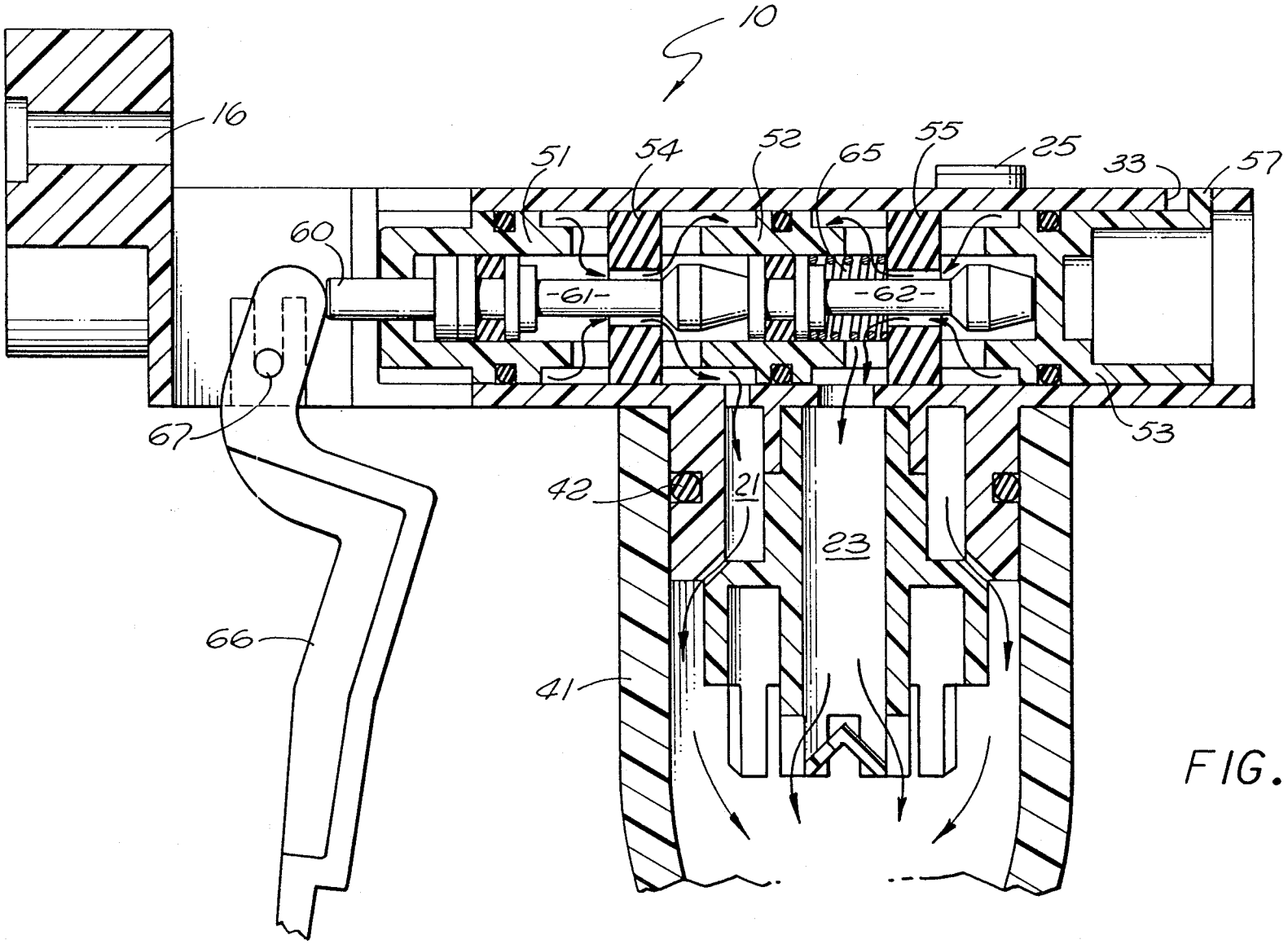
FIG. 4 is a view similar to that of FIG. 3 showing the dispenser in the open position.

As best seen in FIGS. 3 and 6, the chamber 22 is formed by an annular rib 40, with a nozzle 41 being pushed over an O-ring seal 42 onto the annular rib 40. A diffuser 43, which may be conventional in design, is a push fit into an inner annular rib 44 of the housing, and provides a soda flow path from the outlet port 19 through the zone 21 into the interior of the nozzle, and another flow path from the outlet port 20 through the zone 23 into the interior of the nozzle.

Turning now to the valve chamber 11, the preferred embodiment includes a valve sleeve of three sections 51, 52, 53 positioned in the valve chamber 11, with a valve seal or seat 54 between sections 51, 52 and another valve seal or seat 55 between the sections 52, 53. An 0-ring seal 56 is provided for each of the valve sections, and the valve section 53 has a tab 57 for holding the components in the chamber, in the same manner as the tab 32 of the plug 30.

A plunger 60, a poppet 61, and another poppet 62 are positioned within the sleeve sections. The left end of the plunger 60 projects through openings in the sleeve section 51 and the valve chamber 11 into a zone 63 of the housing. The poppet 61 slides in an opening in the valve seat 54, and may carry a seal 64 at the left end. The poppet 62, which may be identical to the poppet 61, slides in an opening in the valve seat 55 and may carry a seal 64. In the preferred embodiment, a spring 65 is positioned about the poppet 62 between a flange of the poppet and the valve seat 55, urging the poppet to the left or valve closed position, with the poppet in sealing engagement with the valve seat. In the poppet 61, the diameter of the left end is greater than the diameter of the right end so that the force on the poppet resulting from a fluid under pressure moves the poppet to the left bringing the poppet into sealing engagement with the valve seat 54. The components are dimensioned so that when both poppets are in sealing engagement with the respective valve seats, there is a space between the two poppets, as seen in FIG. 3.

The valve actuator mechanism includes a lever 66 with a pivot pin 67 resting in slots 68 formed in the housing in the area 63.

The sleeve section 51 has one or more slots 71 at the right end, which provide for communication between the exterior and the interior of the sleeve. Similarly, the sleeve section 52 has one or more slots 72 at the left end and one or more slots 73 at the right end, and the sleeve section 53 has one or more slots 74 at the left end.

In operation, a source of soda is connected at the inlet opening 15 and soda flows into the chamber 13 and along the path 34 through inlet port 17 and slots 71 into the interior of the sleeve section 51, moving the poppet 61 to the left and producing sealing engagement between the poppet 61 and the seat 54. A supply of syrup is similarly connected at the inlet opening 14 and flows into the chamber 12 and along the path 36 through inlet port 18 and slots 74 into the interior of the sleeve section 53. The spring 65 moves the poppet 62 to the left into sealing engagement with the valve seat 55.

A mixed drink is dispensed by pivoting the lever 66 clockwise, typically by pressing a cup against the lower portion of the lever. The upper end of the lever moves to the right engaging the plunger 60 and moving the poppet 61 to the right, breaking the seal between the poppet 61 and the valve seat 54 and providing for fluid flow from the interior of the sleeve section 51, through the opening in the valve seat 54 into the left interior of the sleeve section 52, and through slots 72 and outlet port 19 into the zone 21 of the diffuser 43.

The movement of the poppet 61 brings it into engagement with the poppet 62 and moves the poppet 62 to the right breaking the hydrostatic seal with the valve seat 55. This permits fluid flow from the interior of the sleeve section 53 through the opening in the valve seat 55 into the right interior of the sleeve section 52, and through slots 73 and outlet port 20 into the zone 23 of the diffuser. The syrup and soda flow downward through the diffuser and out into the nozzle 41, providing the mixed drink at the outlet of the nozzle.

Dispensing is terminated by releasing the pressure on the lever 66, with the spring 65 moving the plunger 62 to the left and the fluid pressure on the poppet 61 moving it to the left, with the poppets sealing at the respective valve seats. The dispenser is now ready for dispensing another mixed drink.

Tests on apparatus as illustrated and described above show that the force required for operation of the dispenser has been reduced in the order of twenty percent as compared to other mechanical valve arrangements presently available. Thus it is seen that the likelihood of collapsing or damaging a cup has been reduced, while maintaining control of drink mixing and dispensing. The device of the present invention provides a fully mechanical countertop-type drink dispenser suitable for touch faucet operation with lowered actuating force requirements and with modular components in a unitary housing which provides a compact installation. Also, the construction offers low profile and minimal space requirements which in turn allows for more units in a given counter space, or conversely, more counter space.

I claim:

1. In a post-mix drink dispensing system, the combination of:

a housing having a valve chamber with first and second inlet ports, first and second outlet ports, and first and second valve seat means, said housing including an outlet nozzle and separate passage means interconnecting each of said first and second outlet ports with said outlet nozzle, with said first seat means having a first opening defining a flow path in said valve chamber between said first inlet and outlet ports, and with said second seat means having a second opening defining a flow path in said valve chamber between said second inlet and outlet ports;

a first valve port poppet slidingly positioned in said first opening for sealing engagement with said first valve seat means;

a second valve poppet slidingly positioned in said second opening for sealing engagement with said second valve seat means, with said first valve poppet spaced from said second valve poppet when both are in sealing engagement with the respective valve seat means; and valve actuator means for engaging said first poppet for moving said first poppet away from said first valve seat means and into engagement with said second poppet for moving said second poppet away from said second valve seat means, said valve actuator means including a valve plunger separate from said poppets and slidingly positioned in said chamber, with said separate plunger and first and second poppets in alignment.

2. A system as defined in claim 1 wherein said valve actuator means includes a lever separate from said valve plunger and pivotally mounted in said housing for engaging said valve plunger, with said lever spaced from said plunger when both of said poppets are in sealing engagement with the respective valve seat means.

3. A system as defined in claim 1 including a spring positioned for engaging said second valve poppet for urging said second valve poppet toward said first valve poppet.

4. A system as defined in claim 3 wherein said first valve poppet has a first end remote from said second valve poppet and a second end adjacent said second valve poppet, with said first end of greater diameter than said second end.

5. A system as defined in claim 4 including means for connecting a source of a diluent fluid to said first inlet port, and means for connecting a source of a concentrate fluid to said second inlet port.

6. In a post-mix drink dispensing system, the combination of:

a housing having a valve chamber with first and second inlet ports, first and second outlet ports, and first and second valve seat means, with said first seat means having a first opening defining a flow path in said valve chamber between said first inlet and outlet ports, and with said second seat means having a second opening defining a flow path in said valve chamber between said second inlet and outlet ports;

a first valve poppet slidingly positioned in said first opening for sealing engagement with said first valve seat means;

a second valve poppet slidingly positioned in said second opening for sealing engagement with said second valve seat means, with said first valve poppet spaced from said second valve poppet when both are in sealing engagement with the respective valve seat means;

valve actuator means for engaging said first poppet for moving said first poppet away from said first valve seat means and into engagement with said second poppet for moving said second poppet away from said second valve seat means; and valve sleeve means positioned within said valve chamber and having first, second and third aligned sections, with said first valve seat means positioned between said first and second sleeve sections and with said second valve seat means positioned between said second and third sleeve sections, with said first sleeve section in communication with said first inlet port, with said second sleeve section in communication with said first outlet port and said second outlet port and including seal means separating said outlet ports, and with said third sleeve section in communication with said second inlet port.

7. A system as defined in claim 6 wherein said housing includes:

first and second inlet chambers contiguous with said valve chamber, and having means defining a first flow path between said first inlet chamber and said first inlet port and means defining a second flow path between said second inlet chamber and said second inlet port; and means for connecting a first fluid source to said first inlet chamber and a second fluid source to said second inlet chamber.

8. In a touch faucet post-mix drink dispensing system, the combination of:

a housing having a valve chamber with first and second inlet ports, first and second outlet ports, and first and second valve seat means, with said first seat means having a first opening defining a flow path in said valve chamber between said first inlet and outlet ports, and with said second seat means having a second opening defining a flow path in said valve chamber between said second inlet and outlet ports;

a first valve poppet slidingly positioned in said first opening for sealing engagement with said first valve seat means;

a second valve poppet slidingly positioned in said second opening for sealing engagement with said second valve seat means, with said first valve poppet spaced from said second valve poppet when both are in sealing engagement with the respective valve seat means;

valve sleeve means positioned within said valve chamber and having first, second and third aligned sections, with said first valve seat means positioned between said first and second sleeve sections and with said second valve seat means positioned between said second and third sleeve sections, with said first sleeve section in communication with said first inlet port, with said second sleeve section in communication with said first outlet port and said second outlet port and including seal means separating said outlet ports, and with said third sleeve section in communication with said second inlet port;

a spring positioned for engaging said second valve poppet for urging said second valve poppet toward said first valve poppet, with said first valve poppet having a first end remote from said second valve poppet and a second end adjacent said second valve poppet, with said first end of greater diameter than said second end;

means for connecting a source of a diluent fluid to said first inlet port, and means for connecting a source of a concentrate fluid to said second inlet port; and valve actuator means for engaging said first poppet for moving said first poppet away from said first valve seat means and into engagement with said second poppet for moving said second poppet away from said second valve seat means, said valve actuator means including a valve plunger slidingly positioned in said chamber, with said plunger, first and second poppets in alignment, and a lever pivotally mounted in said housing for engaging said valve plunger.

9. A system as defined in claim 8 wherein said housing includes:

first and second inlet chambers contiguous with said valve chamber, and having means defining a first flow path between said first inlet chamber and said first inlet port and means defining a second flow path between said second inlet chamber and said second inlet port.

* * * * *